US008967585B2

(12) United States Patent
Furuta et al.

(10) Patent No.: US 8,967,585 B2
(45) Date of Patent: Mar. 3, 2015

(54) STAND FOR MUSICAL INSTRUMENT

(75) Inventors: Hajime Furuta, Nagoya (JP); Yuko Naganawa, Nagoya (JP)

(73) Assignee: Hoshino Gakki Co., Ltd., Nagoya (JP)

( * ) Notice: Subject to any disclaimer, the term of this patent is extended or adjusted under 35 U.S.C. 154(b) by 256 days.

(21) Appl. No.: 13/219,716

(22) Filed: Aug. 29, 2011

(65) Prior Publication Data

US 2013/0048804 A1 Feb. 28, 2013

(51) Int. Cl.
*G10G 5/00* (2006.01)

(52) U.S. Cl.
CPC ..... *G10G 5/00* (2013.01)
USPC ..... 248/443; 248/447; 248/463; 248/464; 248/166; 248/168; 84/327

(58) Field of Classification Search
CPC ..... A47B 19/002; A47B 19/06; A47B 19/08; A47B 23/043; A47B 97/08; G10G 5/00
USPC ..... 248/443, 447, 457, 459, 460, 462, 463, 248/461, 464, 458, 441.1, 127, 150, 163.1, 248/165, 166, 168, 434, 170, 173, 453, 248/221.11; 224/910; 84/327, 329, 421, 84/453; 24/30.5 R, 585.1, 585.12
See application file for complete search history.

(56) References Cited

U.S. PATENT DOCUMENTS 2,973,933 A * 3/1961 Howell ..... 248/460
4,109,889 A * 8/1978 Durket ..... 248/447
4,691,610 A 9/1987 Gilbert
4,693,161 A 9/1987 Uhrig
5,010,627 A * 4/1991 Herrington et al. ..... 24/400
5,221,066 A * 6/1993 Ferrigan et al. ..... 248/166
5,383,634 A * 1/1995 Liao ..... 248/166
5,505,413 A * 4/1996 Hennessey ..... 248/166
5,664,756 A 9/1997 Liao
5,744,735 A * 4/1998 Liao ..... 84/327
5,959,225 A * 9/1999 Hsu ..... 84/327
5,973,244 A * 10/1999 McCulloch ..... 84/327
6,145,801 A 11/2000 Herring, Jr.
6,323,406 B1 * 11/2001 Park ..... 84/327
6,835,883 B2 * 12/2004 Stevens ..... 84/453
6,870,740 B2 * 3/2005 Hsu et al. ..... 361/732

(Continued)

FOREIGN PATENT DOCUMENTS

CN 101688633 3/2010
GB 2276314 9/1994
JP P09-062256 A 3/1997

OTHER PUBLICATIONS

The extended European search report dated Jul. 23, 2012 issued in European Patent Application No. 11007025.7.

(Continued)

*Primary Examiner* — Jonathan Liu
*Assistant Examiner* — Guang H Guan

(57) ABSTRACT

A guitar stand has a base section, a pair of first frames arranged at an opened position or a closed position, a pair of second frames and a pair of third frames arranged at the use position or the folded position. A slider for holding the first frames at the closed position and the second frames at the folded position is mounted to upper ends of the first frames. The first frames, second frames and the third frames are opened at the same time by unlocking the slider, and the guitar stand in a folded state can be brought into a use state.

6 Claims, 6 Drawing Sheets

(56) References Cited

U.S. PATENT DOCUMENTS

| | | | | |
|---|---|---|---|---|
| 6,971,621 | B2 * | 12/2005 | Gaines | 248/447 |
| 7,470,843 | B2 * | 12/2008 | Hsieh | 84/329 |
| 7,732,688 | B2 * | 6/2010 | Hsieh | 84/327 |
| 7,777,110 | B2 * | 8/2010 | Wallis | 84/327 |
| 8,020,818 | B2 * | 9/2011 | Chou et al. | 248/176.1 |
| D646,283 | S | 10/2011 | Derry et al. | |
| 8,146,870 | B1 * | 4/2012 | Cooper | 248/166 |
| 8,899,543 | B2 * | 12/2014 | Liang et al. | 248/454 |
| 2008/0028912 | A1 | 2/2008 | Sawhney | |
| 2008/0265109 | A1 | 10/2008 | Derry et al. | |
| 2009/0140119 | A1 * | 6/2009 | To et al. | 248/455 |
| 2010/0037747 | A1 | 2/2010 | Hsieh | |
| 2010/0243850 | A1 | 9/2010 | Derry | |
| 2011/0168863 | A1 | 7/2011 | Tregloan | |
| 2013/0048804 | A1 * | 2/2013 | Furuta et al. | 248/168 |

OTHER PUBLICATIONS

The Office Action dated Jul. 16, 2014 issued in Chinese Patent Application No. 201110266196.5 with English language summary.

* cited by examiner

STAND FOR MUSICAL INSTRUMENT

BACKGROUND OF THE INVENTION

The present invention relates to a stand for musical instruments to be used for setting a musical instrument such as a guitar or a bass guitar upright thereon.

As stands for musical instruments, guitar stands are used. In general, a guitar stand 100 is provided with a pipe member 102 having a tripod 101, and a placing section 103 fixed to a lower end of the pipe member 102 as shown in FIG. 8. The body of a guitar is placed on the placing section 103. The neck of the guitar is set on an upper end 102*a* of the pipe member 102 upright.

Players occasionally play the guitars not only indoors, such as in concert halls and clubs with live music, but also outdoors such as on streets and in parks. However, since the guitar stand shown in FIG. 8 has approximately the same size as that of a guitar and cannot be folded, this guitar stand is generally not convenient to carry around and store. For this reason, as disclosed in Japanese Laid-Open Patent Publication No. 9-62256, some foldable guitar stands have been proposed to be more convenient to carry around and store. In these conventional foldable guitar stands, however, the handling from a folded state to a use state (state for use) is bothersome, and thus the guitar stands are not easy to use.

SUMMARY OF THE INVENTION

It is an objective of the present invention to provide a stand for musical instrument that is more convenient to carry around and store and is user-friendly.

According to one embodiment of the present invention, a stand for musical instrument to be used for setting a musical instrument upright thereon includes a base section, a pair of first leg portions that are connected to the base section and are arranged at an opened position where they are opened about the base section and at a closed position where they are closed about the base section, a pair of second leg portions that are connected to lower ends of the pair of first leg portions and are arranged at a use position where they are opened with respect to the first leg portions and a folded position where they are folded with respect to the first leg portions, and a holding member that is mounted to the first leg portions and holds the pair of first leg portions at the closed position and the pair of second leg portions at the folded position. When the holding member is operated, the pair of first leg portions at the closed position is re-arranged to (positioned at) the opened position and the pair of second leg portions at the folded position to the use position.

DETAILED DESCRIPTION OF THE PREFERRED EMBODIMENTS

A preferred embodiment of a stand for musical instruments in accordance with the present invention as implemented for a guitar stand 10 will be described below with reference to FIGS. 1 to 6.

Figure 1:
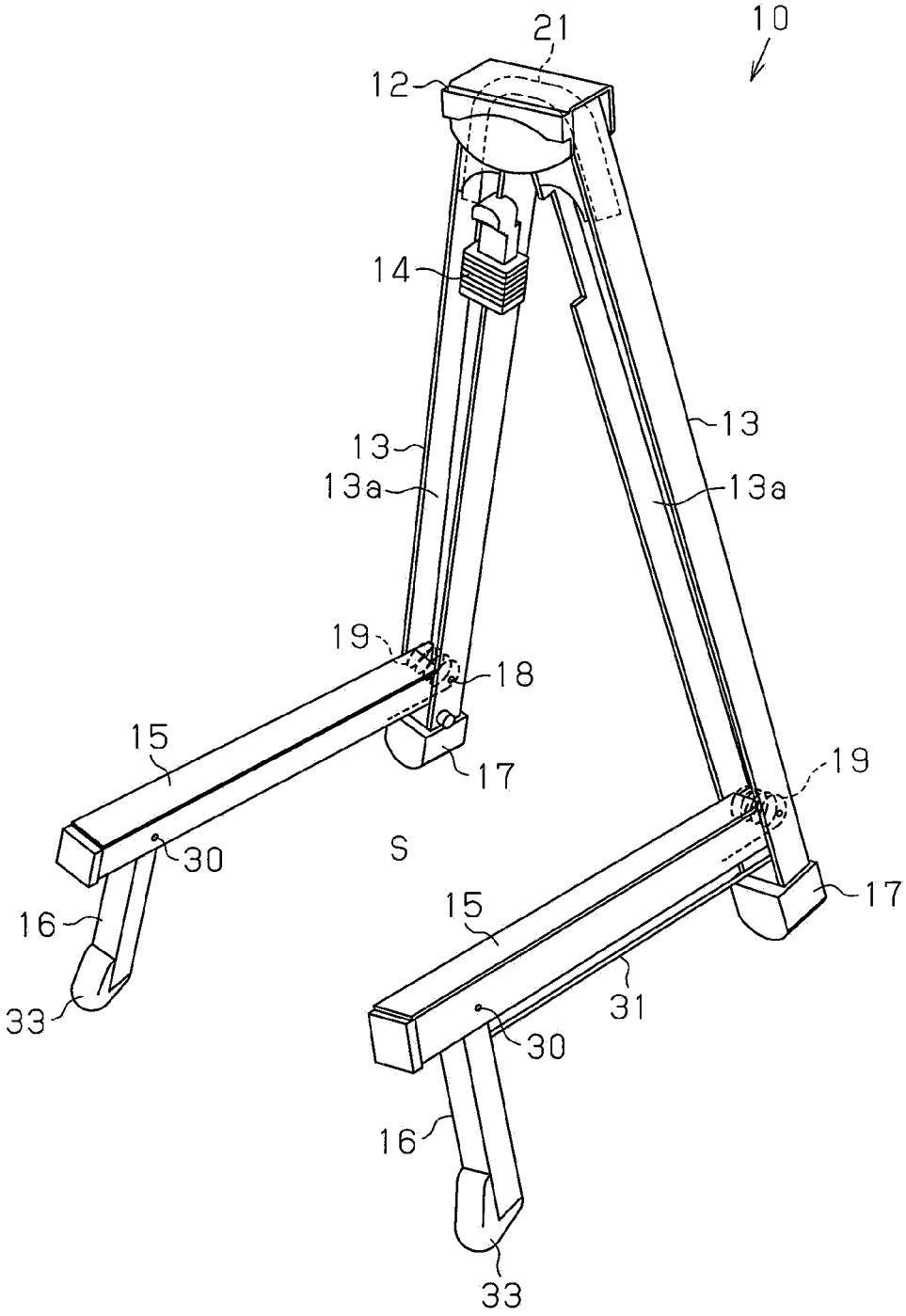
FIG. 1 is a perspective view illustrating an entire guitar stand at the time of use according to one embodiment of the present invention.

As shown in FIG. 1, the guitar stand 10 has a base section 12, first frames 13 as a pair of first leg portions, second frames 15 as a pair of second leg portions, third frames 16 as a pair of third leg portions, and a slider 14 as a holding member.

The first frames 13 are connected to the base section 12 and are capable of being opened and closed about the base section 12. A leaf spring 21, which serves as a first biasing device, is mounted in the base section 12. One end of the leaf spring 21 is fixed to the first frame 13 shown on the left side in FIG. 1, and the other end is fixed to the first frame 13 on the right side in FIG. 1. The leaf spring 21 is fixed to the base section 12 and the first frames 13 in a state where it is folded approximately into a U-shape about the base section 12 as the center. For this reason, the leaf spring 21 is biased in a direction for opening the first frames 13 about the base section 12. Therefore, the first frames 13 are maintained at an opened position where the first frames 13 are opened about the base section 12 by biasing force from the leaf spring 21 at the time of using the guitar stand 10.

The first frames 13 are portions that face the rear surface of the body of a guitar set upright on the guitar stand 10. The first frames 13 are made of a steel material with an approximate U-shaped cross section, and are arranged so that openings 13*a* face forward. The openings 13*a* of the first frames 13 are used as housing spaces for housing the second frames 15. The first frames 13 extend in an inclined manner from the base section 12 to a placing surface S on which the guitar is set.

Figure 2:
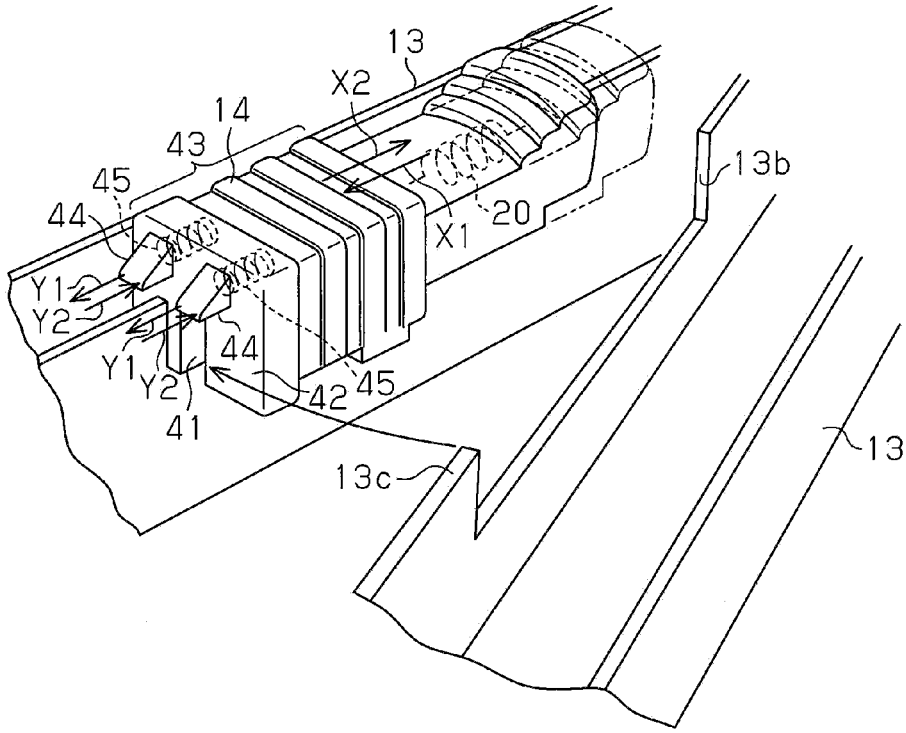
FIG. 2 is an enlarged perspective view illustrating the vicinity of a slider of the guitar stand at the time of use.

As shown in FIGS. 1 and 2, the slider 14 is located in the vicinity of the upper end of the left first frame 13 and can slide between a locked position and an unlocked position. As shown by lines formed by a long dash alternating with two short dashes in FIG. 2, the unlocked position is on a side slightly closer to the base section 12 than the locked position of the slider 14 shown by a solid line in FIG. 2. A spring 20 as well as the slider 14 is mounted to the left first frame 13. For this reason, as shown by arrow X1 in FIG. 2, the slider 14 is held at the locked position in a state where it is biased by the spring 20.

A groove 41 is formed on the slider 14 so as to extend along an axial line of the left first frame 13. A tapered surface 42 is formed on the slider 14 so as to extend from its end to its side wall. On the other hand, the right first frame 13 has a release recess 13*b* at a position corresponding to a thick wall portion 43 of the slider 14. A pair of protrusions 44 is mounted to the slider 14 so as to be capable of extending and retracting. The protrusions 44 protrude towards each of the second frames 15. A pair of springs 45 is mounted to the slider 14. Each spring 45 corresponds to one of the protrusions 44. For this reason, as shown by the arrows Y1 in FIG. 2, the protrusions 44 are held at a protruded position while being biased by the springs 45. A rubber cap 17 is attached to respective lower ends of the first frames 13.

Figure 4:
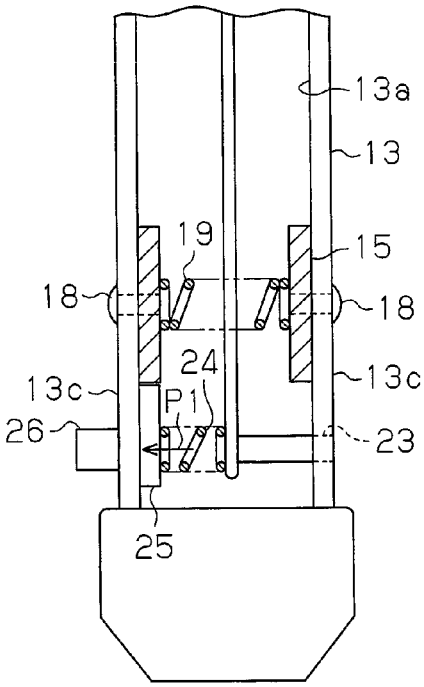
FIG. 4 is an enlarged front view illustrating the vicinity of a restricting device of the guitar stand at the time of use.
Figure 5:
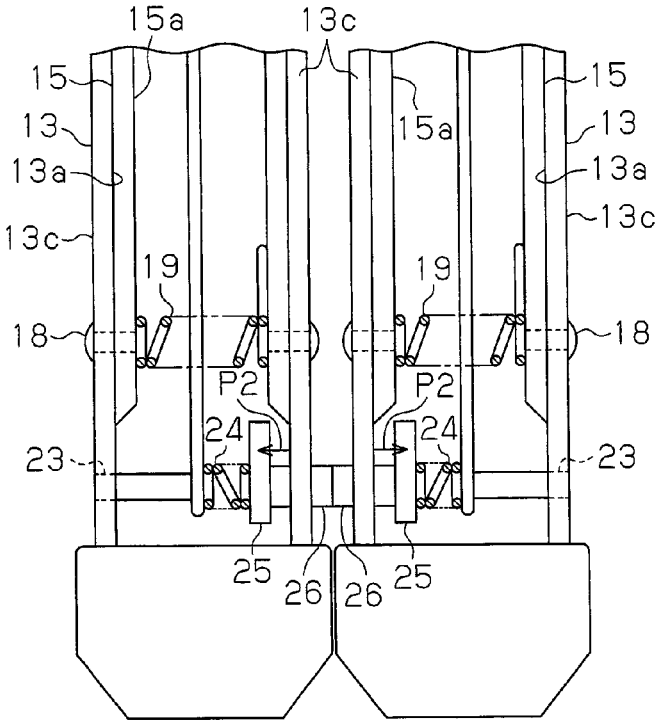
FIG. 5 is an enlarged front view illustrating the vicinity of the restricting device of the folded guitar stand.

As shown in FIGS. 1, 4 and 5, the second frames 15 are connected to the lower ends of the first frames 13, respectively, via connecting shafts 18. The second frames 15 are foldable and are connected to the first frames 13. Torsion coil springs 19, which serve as second biasing devices, are mounted to lower ends of the first frames 13, respectively. One end of each torsion coil spring 19 is fixed to the lower end of each first frame 13, and the other end is connected to the proximal end of each second frame 15. The torsion coil springs 19, bias the first frames 13 toward a direction for opening the second frames 15 about the connecting shafts 18. For this reason, the second frames 15 are held at a use position where they are opened with respect to the first frames 13 by the biasing forces from the torsion coil springs 19 when using the guitar stand 10.

Pins 23 that pass through side walls 13*c* of the first frames 13 are supported on the lower ends of the first frames 13. Disc-shaped stoppers 25 are supported from the pins 23 via springs 24. Cylindrical buttons 26 are formed integrally with the stoppers 25. As shown by the arrow P1 in FIG. 4, the springs 24 bias the stoppers 25 towards inner surfaces of the side walls 13*c* of the first frames 13. The stoppers 25, which serve as restricting devices, restrict rotation of the second frames 15 about the connecting shafts 18 while the stoppers 25 are abutted against the side walls 13*c* of the first frames 13. On the other hand, as shown in FIG. 5, when the stoppers 25 are separated from the side walls 13*c* of the first frames 13, the restriction of rotation of the second frames 15 about the connecting shafts 18 is removed.

Figure 6:
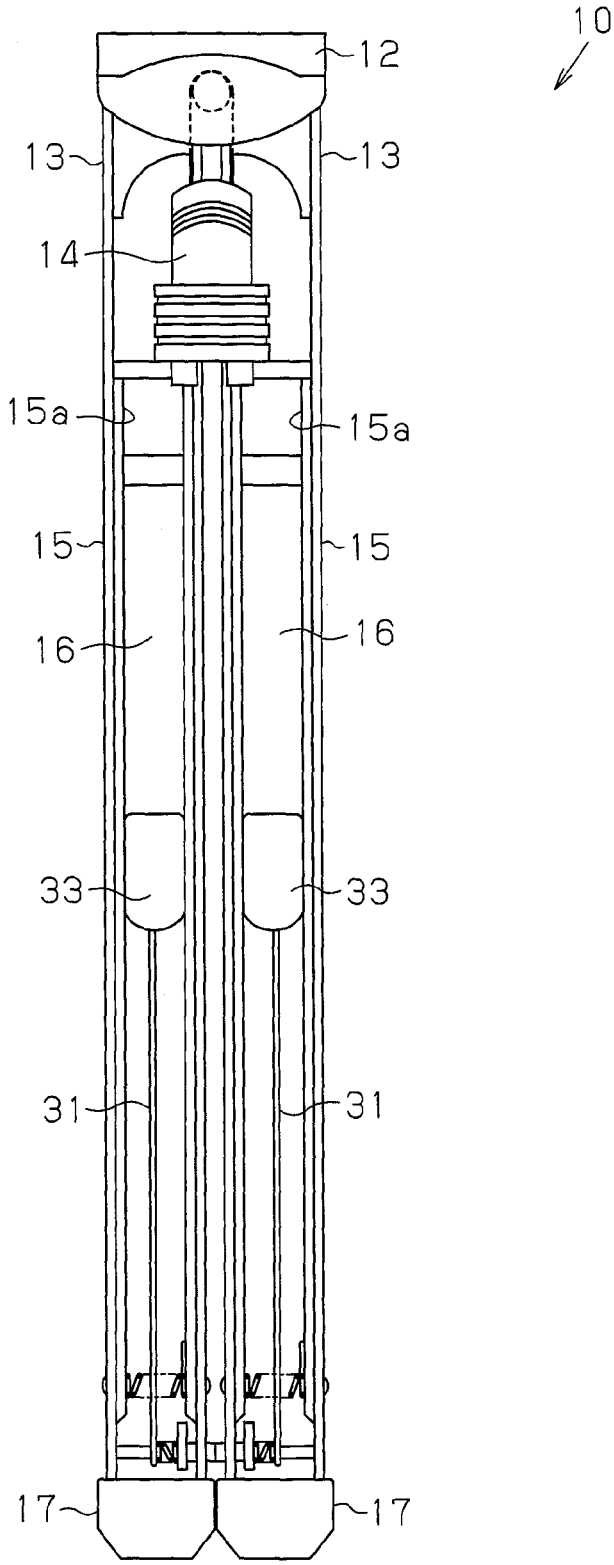
FIG. 6 is a perspective view illustrating the entire folded guitar stand.

The second frames 15 are portions that face the bottom surface of a guitar when the guitar is set upright on the guitar stand 10. The second frames 15 are arranged parallel to each other and extend from the lower ends of the first frames 13 along the placing surface S. The second frames 15 are made of a steel material with a U-shaped cross section and have openings 15*a*, or channels, facing downward. As shown in FIG. 6, the openings 15*a* of the second frames 15 are used as spaces for housing the third frames 16.

The third frames 16 are connected to distal ends of the second frames 15, respectively, via connecting shafts 30. The third frames 16 are foldable and are connected to the second frames 15. Proximal ends of the third frames 16 are connected to the lower ends of the first frames 13, respectively, via wires 31. The third frames 16 extend downward from the distal ends of the second frames 15 during use of the guitar stand 10. The third frames 16 are held by the wires 31 in the use position where they are opened with respect to the second frames 15. Rubber caps 33 are attached to the lower ends of the third frames 16, respectively, in a manner similar to the first frames 13.

The operation of the guitar stand 10 will be described below with reference to FIGS. 2 to 6.

An operating sequence from the use state (open state) of the guitar stand 10 to a folded state will now be described. In the guitar stand 10, after an operation for closing the first frames 13, an operation for folding the second frames 15 and an operation for folding the third frames 16 are performed at the same time.

Figure 3:
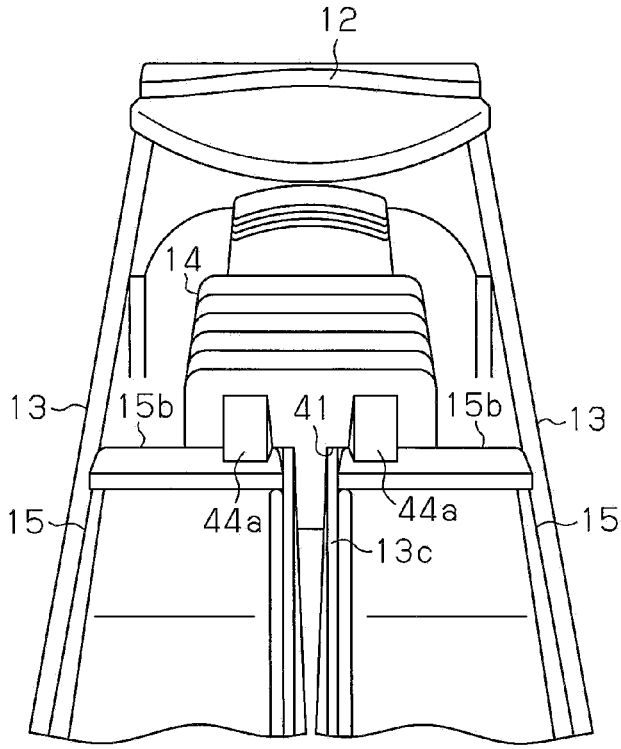
FIG. 3 is an enlarged perspective view illustrating the vicinity of the slider of the folded guitar stand.

As shown in FIGS. 2 and 3, in the operation for closing the first frames 13, the first frames 13 are moved rotationally about the base section 12 toward one another. At this time, the side wall 13*c* near the release recess 13*b* on the right first frame 13 moves towards an entrance of the groove 41 while sliding on the tapered surface 42 of the slider 14. Further, as shown by the arrow X2 in FIG. 2, the slider 14 is pushed up toward the base section 12 against the biasing force of the spring 20 by the side wall 13*c*, which slides on the tapered surfaces 42. When the side wall 13*c* enters the groove 41 of the slider 14, the slider 14 is returned to an original locked position by the biasing force of the spring 20. When the slider 14 is arranged at the locked position, the first frames 13 are held at the closed position.

When the first frames 13 are held at the closed position, as shown in FIG. 5, the lower ends of the closed first frames 13 closely contact each other, and the buttons 26 of the first frames 13 are pressed against each other. As a result, as shown by the arrows P2 in FIG. 5, the stoppers 25 of the first frames 13 are separated from the side walls 13*c* of the first frames 13 against the biasing forces of the springs 24. As a result, the restriction from rotation of the second frames 15 about the connecting shafts 18 is removed. For this reason, the second frames 15 move pivotally about the connecting shafts 18 and are folded with respect to the first frames 13 to be housed in the openings 13*a* of the first frames 13. The position of the second frames 15 when folded with respect to the first frames 13 is referred to as a folded position of the second frames 15.

As shown in FIGS. 2 and 3, when the second frames 15 are arranged at the folded position, tapered surfaces 44*a* of the protrusions 44 of the slider 14 are pressed by distal ends 15*b* of the second frames 15. At this time, as shown by the arrows Y2 in FIG. 2, the protrusions 44 are pushed up to the side of the base section 12 by the distal ends 15*b* of the second frames 15. As a result, the protrusions 44 partially retract into the slider 14 against the biasing forces of the springs 45. When the distal ends 15*b* of the second frames 15 are further pushed beyond the protrusions 44, the protrusions 44 are returned to the original protrusion positions by the biasing forces of the springs 45. When the protrusions 44 return to the original protrusion positions to lock the distal ends 15*b* of the second frames 15, the second frames 15 are held at the folded position.

As shown in FIGS. 1 and 6, during the folding operation of the second frames 15, distal ends of the third frames 16 are pulled by the wires 31, and the third frames 16 move pivotally about the connecting shafts 30. As a result, the third frames 16 are folded with respect to the second frames 15 to be housed in the openings 15*a* of the second frames 15. The position of the third frames 16 when folded with respect to the second frames 15 is referred tows the folded position of the third frames 16.

An operating sequence from a state in which the guitar stand 10 is folded to the use state will now be described. In the guitar stand 10 according to the embodiment, when the slider 14 is operated, an operation for opening the first frames 13 and an operation for opening the folded second frames 15, and an operation for opening the folded third frames 16 are performed simultaneously and quickly.

When the guitar stand 10 is opened, the slider 14 is moved manually from the locked position to the unlocked position. As a result, the side wall 13*c* near the release recess 13*b* of the right first frame 13 escapes from the groove 41 of the slider 14, and the protrusions 44 of the slider 14 separate from the distal ends 15*b* of the second frames 15. When the holding of the first frames 13 and the second frames 15 by means of the slider 14 is removed, the leaf spring 21 quickly opens the first frames 13, and the torsion coil springs 19 quickly open the second frames 15 with respect to the first frames 13. At the same time, the wires 31 open the third frames 16 with respect to the second frames 15. Further, the first frames 13 are held at an opened position by the leaf spring 21, and the second frames 15 are held at the use position by the torsion coil springs 19. The third frames 16 are also held at the use position by the wires 31. In this way after the folded guitar stand 10 is opened, the slider 14 is returned to the original locked position by biasing of the spring 20.

According to this embodiment, the following advantages are achieved.

(1) The slider 14 is located near the upper end of the left first frame 13. The slider 14 holds the pair of first frames 13 at the closed position, and the pair of second frames 15 can be held at the folded position. As a result, the guitar stand 10 can be folded compactly. On the other hand, when the slider 14 is operated, the pair of first frames 13 at the closed position is re-arranged to (positioned at) the opened position, and the pair of second frames 15 at the folded position is re-arranged to (positioned at) the use position. As a result, the folded guitar stand 10 is opened to be brought into the use state. Therefore, the guitar stand 10 can be provided that is convenient to carry around and store and is user-friendly.

(2) The slider 14 is mounted to a portion near the upper end of the left first frame 13 to slide between the locked position and the unlocked position. For this reason, the guitar stand 10, which is folded compactly, can be opened into the use state merely by a simple sliding operation of the slider 14. That is to say, the folded guitar stand 10 can be opened with a single operation at the time of use.

(3) The leaf spring 21 serves as the first biasing device in the base section 12. The leaf spring 21 biases the first frames 13 in a direction for opening the first frames 13 about the base section 12. For this reason, the pair of first frames 13 is quickly opened about the base section 12 by the biasing force of the leaf spring 21, and can be held in the opened state.

(4) The groove 41, which is formed on the slider 14, extends along the axial line of one of the first frames 13. For this reason, the side walls 13*c* of the first frames 13 are locked to the groove 41 of the slider 14, so that the pair of first frames 13 can be held in the closed state.

(5) The torsion coil springs 19 as second biasing devices are mounted to the lower ends of the first frames 13, respectively. The torsion coil springs 19 bias the first frames 13 toward the direction for opening the second frames 15 about the connecting shafts 18. For this reason, the biasing forces of the torsion coil springs 19 pivotally move the second frames 15 about the connecting shafts 18 from the folded position to the use position quickly, and the second frames 15 can be held at the use position.

(6) The pair of protrusions 44 is attached to the slider 14 and is capable of extending and retracting. For this reason, the distal ends 15*b* of the second frames 15 are locked to the protrusions 44 of the slider 14, so that the pair of second frames 15 can be held at the folded position.

(7) The stoppers 25, or restricting devices, restrict the rotational movement of the second frames 15 about the connecting shafts 18, while being abutted against the side walls 13*c* of the first frames 13. Since the stoppers 25 can fix the second frames 15 to the use position, the state of the guitar stand 10 at the time of use is stabilized.

(8) When the second frames 15 are folded, the lower ends of the closed first frames 13 closely contact each other, and the buttons 26 of the first frames 13 are pressed against each other. As a result, as shown by the arrow P2 in FIG. 5, the stoppers 25 of the first frames 13 are separated from the side walls 13*c* of the first frames 13 against the biasing forces of the springs 24. As a result, the restriction of rotational movement of the second frames 15 about the connecting shafts 18 is removed. This allows the operation for arranging the pair of first frames 13 at the closed position and the operation for removing the restriction of the rotational movement of the second frames 15 about the connecting shafts 18 to be performed at the same time. Therefore, the series of operations for folding the guitar stand 10 is simplified.

(9) The third frames 16 are connected to the distal ends of the second frames 15, respectively, via the connecting shafts 30. In this case, since the distal ends of the second frames 15 are supported by the third frames 16, the state of the guitar stand 10 at the time of use is stabilized.

(10) The second frames 15 are folded with respect to the pair of first frames 13 to be housed in the openings 13*a* of the pair of first frames 13. Further, the third frames 16 are folded with respect to the second frames 15 to be housed in the openings 15*a* of the second frames 15. For this reason, the guitar stand 10 can be folded more compactly.

The above illustrated embodiment may be changed as follows.

Figure 7:
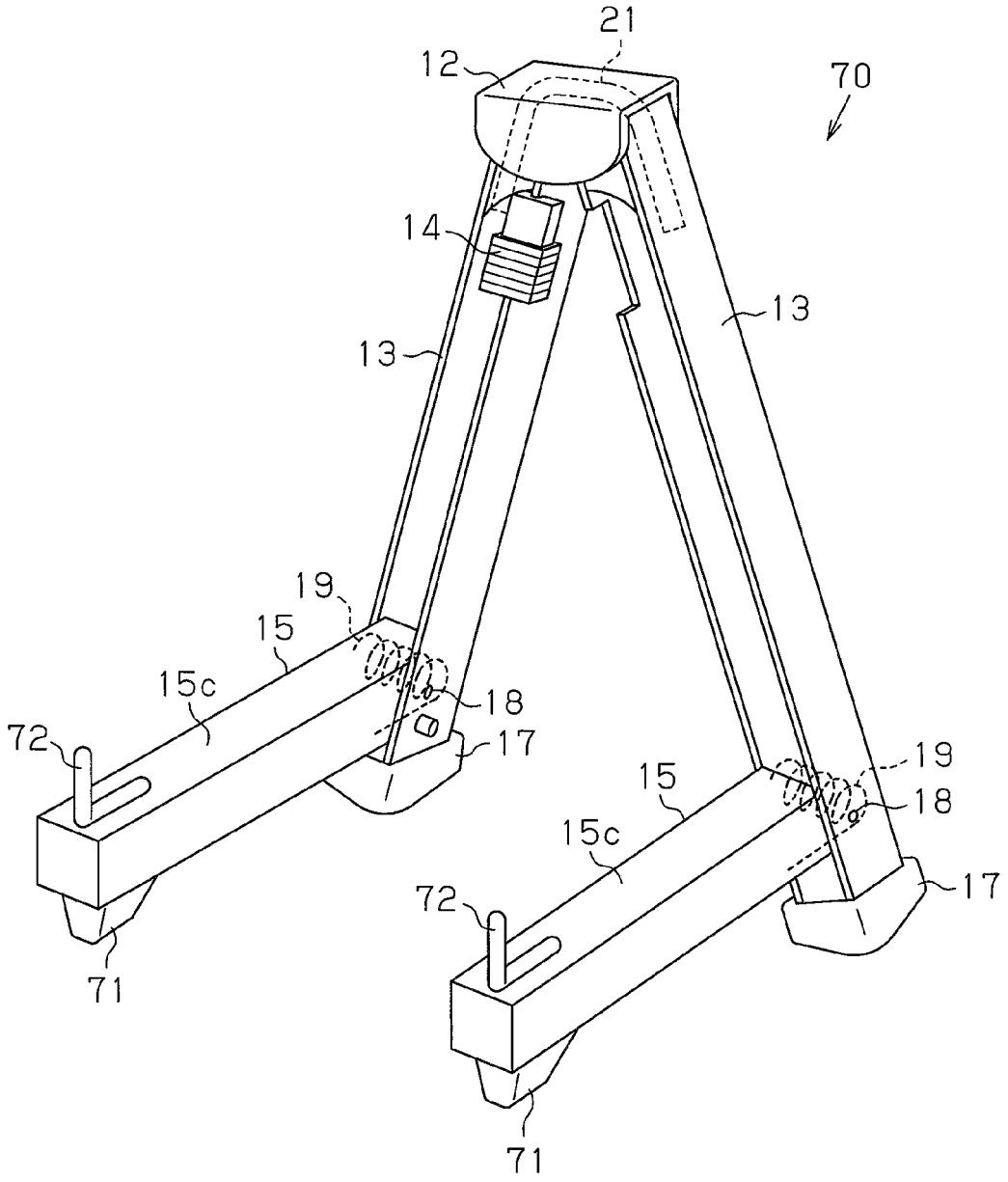
FIG. 7 is a perspective view illustrating the guitar stand of a modification.
Figure 8:
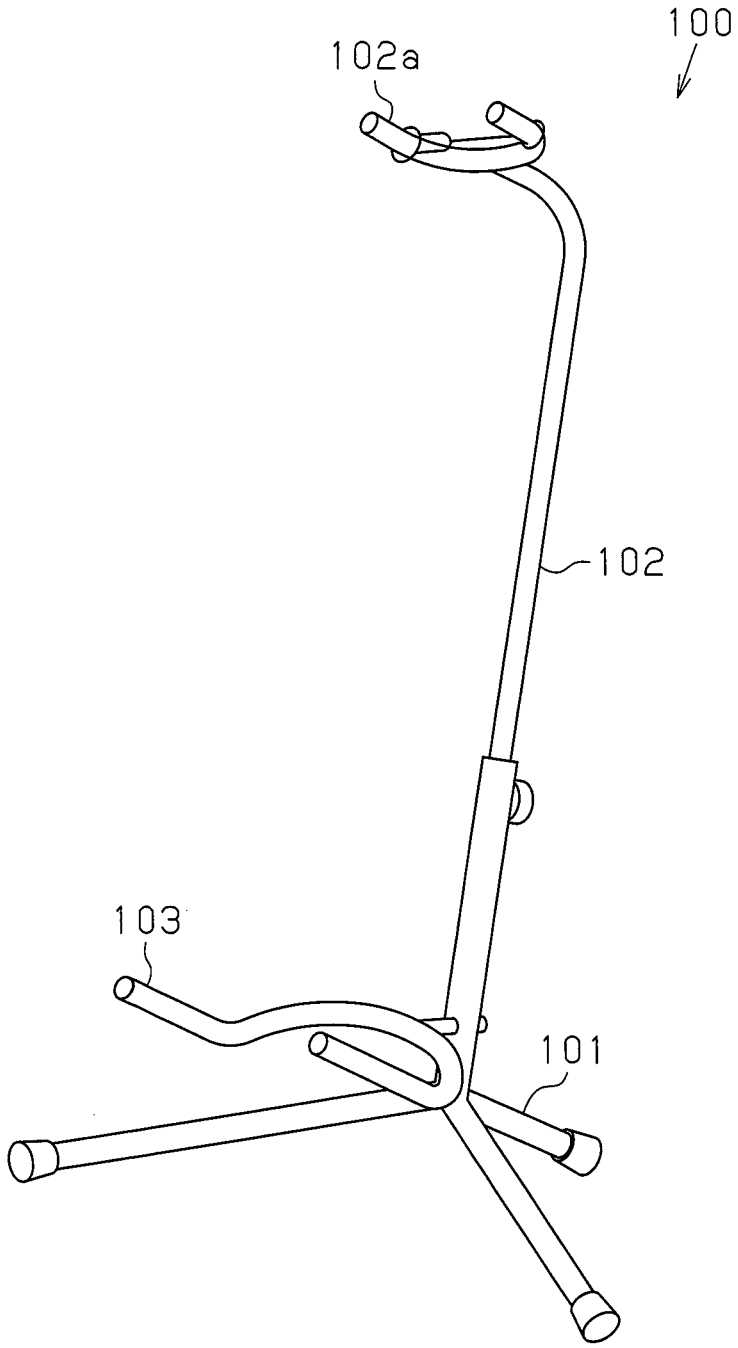
Fig.8(Prior Art)
FIG. 8 is a perspective view illustrating a conventional guitar stand.

As shown in FIG. 7, the third frames 16 may be omitted from the guitar stand 10 shown in FIG. 1. In this case, instead of the third frames 16, supporting pieces 71 that protrude towards the placing surfaces S are fixed to the distal ends of the second frames 15.

As shown in FIG. 7, stoppers 72 may be provided on upper surfaces 15*c* of the second frames 15 to prevent a guitar resting upright on the guitar stand 10 from slipping off the second frames 15. In this case, stoppers may have any suitable shape, for example, L-shaped or U-shaped stoppers, may be used. For the same purpose as that of the stoppers 72, rubber sheets or cushion materials or the like may be adhered to the upper surfaces 15*c* of the second frames 15.

In the above illustrated embodiment, the leaf spring 21, or the first biasing device, may be replaced with any suitable spring such as a torsion coil spring. The torsion coil springs 19, or the second biasing devices, may be replaced with any suitable springs such as leaf springs.

In the above illustrated embodiment, the folded guitar stand 10 is opened by a sliding operation of the slider 14, but the guitar stand 10 may be opened by, for example, a pushing operation.

In the above illustrated embodiment, as long as the second frames 15 are folded with respect to the pair of first frames 13 with the guitar stand 10 being folded, the second frames 15 do not have to be housed in the openings 13*a* of first frames 13. Similarly, as long as the third frames 16 are folded with respect to the second frames 15, the third frames 16 do not have to be housed in the openings 15*a* of the second frames 15.

In the above illustrated embodiment, magnets may be fixed to the left first frame 13 and the right first frame 13, respectively, to hold the first frames 13 at the closed position.

In the above illustrated embodiment, the first and second leg portions are implemented as the first and second frames 13 and 15 made of steel materials with U-shaped cross sections. However, the cross-section may take on any shape as long as the leg portions are composed of rigid, elongated members, and any materials such as wood or resin may be used to form such members.

In the above illustrated embodiment, the stand a musical instrument is implemented as a guitar stand, but it may be implemented as a stand for setting upright other stringed instruments such as bass guitars, violins or ukuleles thereon, or a stand for setting musical instruments other than stringed instrument upright thereon.

The invention claimed is:

1. A stand for a musical instrument to be used for setting the musical instrument upright, the stand comprising:

a base section;

a pair of first leg portions connected to the base section, wherein the first leg portions have an opened position, in which the first leg portions are opened about the base section, and a closed position, in which the first leg portions are closed about the base section;

a first biasing device mounted to the base section, wherein the first biasing device biases the first leg portions in a direction for opening the first leg portions about the base section;

a pair of second leg portions connected to lower ends of the first leg portions, wherein the second leg portions have a use position, in which the second leg portions are opened about the first leg portions, and a folded position, in which the second leg portions are folded about the first leg portions;

two connecting shafts that respectively connect the first leg portions to the second leg portions, such that one connecting shaft is located at a joint between each of the first leg portions and a corresponding one of the second leg portions, wherein second biasing devices, which are different from the first biasing device, are respectively associated with the connecting shafts, and each second leg portion is biased by a corresponding one of the second biasing devices to move pivotally about a corresponding one of the connecting shafts from the folded position to the use position;

a holding device for holding the pair of first leg portions at the closed position and holding the pair of second leg portions at the folded position, wherein the holding device is located on at least one of the first leg portions so that the holding device slides between a locked position and an unlocked position; and a locked-position biasing device for biasing the holding device toward the locked position, wherein by moving the holding device from the locked position to the unlocked position against a biasing force of the locked-position biasing device, a holding of the first leg portions and the second leg portions by the holding device is released, and the first leg portions are moved to and held at the opened position by the first biasing device and the second leg portions are moved to and held at the use position by the second biasing devices, the holding device is mounted to a primary one of the first leg portions, is adapted to slide along a side wall of the primary first leg portion, and includes a groove extending in an axial direction of the primary first leg portion, a secondary one of the first leg portions has a release recess at a position corresponding to the holding device, and the holding device is adapted to slide along a side wall of the secondary first leg portion near the release recess, the holding device is adapted to move from the locked position to the unlocked position against the biasing force of the locked-position biasing device by sliding along the side wall of the secondary first leg portion to the release recess, and the holding device is adapted to be returned to the locked position when the side wall of the secondary first leg portion enters the groove, to hold the first leq portions at the closed position.

2. The stand according to claim 1, wherein protrusions that protrude towards the pair of second leg portions, respectively, are provided on the holding device, and distal ends of the second leg portions are locked by the protrusions to hold the pair of second leg portions at the folded position.

3. The stand according to claim 1, further comprising a a pair of restricting devices for restricting pivotal movements of the second leg portions about the connecting shafts, respectively, wherein the restricting devices fix the second leg portions in the use position.

4. The stand according to claim 3, wherein when the pair of first leg portions is arranged at the closed position, the restriction of the pivotal movements of the second leg portions about the connecting shafts is removed.

5. The stand according to claim 1, further comprising a pair of third leg portions provided on distal ends of the pair of second leg portions, wherein the third leg portions have a use position, in which the third leg portions are opened about the second leg portions, and a folded position, in which the third leg portions are folded about the second leg portions.

6. The stand according to claim 5, wherein the first and second leg portions include frames with U-shaped cross sections, and when the second leg portions are arranged at the folded position, the third leg portions are housed in openings of the second leg portions, and the second leg portions are housed in openings of the first leg portions.

* * * * *